US008123569B2

(12) United States Patent
Little et al.

(10) Patent No.: US 8,123,569 B2
(45) Date of Patent: Feb. 28, 2012

(54) WATERPROOF AUDIO JACK CONNECTOR

(75) Inventors: Terrance F. Little, York, PA (US); Howard Wallace Andrews, Hummelstown, PA (US); Michael McKee, Camp Hill, PA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 47 days.

(21) Appl. No.: 12/701,631

(22) Filed: Feb. 8, 2010

(65) Prior Publication Data

US 2011/0195611 A1 Aug. 11, 2011

(51) Int. Cl.
*H01R 24/04* (2006.01)

(52) U.S. Cl. ..... 439/669

(58) Field of Classification Search ..... 439/668, 439/669

See application file for complete search history.

(56) References Cited

U.S. PATENT DOCUMENTS 4,165,147 A * 8/1979 Buck ..... 439/188
5,277,628 A * 1/1994 Lin et al. ..... 439/668
6,000,970 A * 12/1999 Wu ..... 439/669
6,056,602 A * 5/2000 Wu ..... 439/668
6,093,058 A * 7/2000 Wu ..... 439/607.35
6,450,829 B1 * 9/2002 Weisz-Margulescu ..... 439/352
6,869,315 B2 3/2005 Nakai et al.
7,637,787 B2 12/2009 Chien et al.
7,722,413 B2 * 5/2010 Tonosaki ..... 439/751
7,736,191 B1 * 6/2010 Sochor ..... 439/668
2011/0195611 A1 * 8/2011 Little et al. ..... 439/668
2011/0237103 A1 * 9/2011 Harlan et al. ..... 439/271

* cited by examiner

*Primary Examiner* — Neil Abrams
(74) *Attorney, Agent, or Firm* — Wei Te Chung; Andrew C. Cheng; Ming Chieh Chang

(57) ABSTRACT

An audio jack connector (100) includes an insulative housing (1), a plurality of contacts (2) and a cover (3). the insulative housing has a bottom surface (12), a cavity (14) having a front end exposed to exterior for insertion of an electrical plug, and a plurality of receiving slots (15) recessed upwardly from the bottom surface and communicating with the cavity. The contacts are inserted into the receiving slots from the bottom surface of the insulative housing. the contacts have contacting portions (28, 29) protruding into the cavity for contacting with the electrical plug and soldering tail portions (27) extending outwardly beyond the bottom surface. The cover (3) envelopes the contacts into the receiving slots (15) with the tail portions (27) extending outwardly therefrom to make the audio jack connector communicate with the exterior via only the front end of the cavity.

12 Claims, 7 Drawing Sheets

WATERPROOF AUDIO JACK CONNECTOR

BACKGROUND OF THE INVENTION

1. Field of the Invention

The present invention relates to an audio jack connector, and more particularly to a waterproof audio jack connector.

2. Description of Related Art

In the consumer electronics world, many electrical devices, such as cellular phones, MP3 players and miscellaneous portable audio devices require the use of external audio earphones or head phones in order to hear the media sound. By using these earphones or headphones, audio jack connectors must be provided in the audio devices for electrical plugs of the earphones or headphones being plugged into. The audio jack connector usually includes an insulative housing having a cavity for the electrical plug being plugged into and a set of receiving slots communicating with the cavity, and a set of contacts received in the receiving slots and protruding into the cavity for contacting with the electrical plug.

The receiving slots usually are recessed from one or more surfaces of the insulative housing and communicate with exterior so as to allow the contacts inserted into the receiving slots from the respective surfaces. However, In use, water would enter the cavity through the receiving slots easily to form an electrical short circuit.

Hence, an waterproof audio jack connector is desired to overcome the above problems.

BRIEF SUMMARY OF THE INVENTION

According to one aspect of the present invention, an audio jack connector comprises an insulative housing, a plurality of contacts and a cover. the insulative housing has a bottom surface, a cavity having a front end exposed to exterior for insertion of an electrical plug, and a plurality of receiving slots recessed upwardly from the bottom surface and communicating with the cavity. The contacts are inserted into the receiving slots from the bottom surface of the insulative housing. the contacts have contacting portions protruding into the cavity for contacting with the electrical plug and soldering tail portions extending outwardly beyond the bottom surface. The cover envelopes the contacts into the receiving slots with the tail portions extending outwardly therefrom to make the audio jack connector communicate with the exterior via only the front end of the cavity.

According to another aspect of the present invention, an audio jack connector comprises a plurality of contacts having contacting portions for contacting with the electrical plug and tail portions for being mounted to a circuit board; an insulative housing and a cover encapsulating the contacts with the tail portions extending outwardly from the cover when assembled; a cavity defined by the insulative housing and the cover for insertion of the electrical plug and for the contacting portions protruding into; and a plurality of receiving slots defined by the insulative housing and the cover for receiving the contacts. The receiving slots are located at least one side of the cavity and communicate with the cavity.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
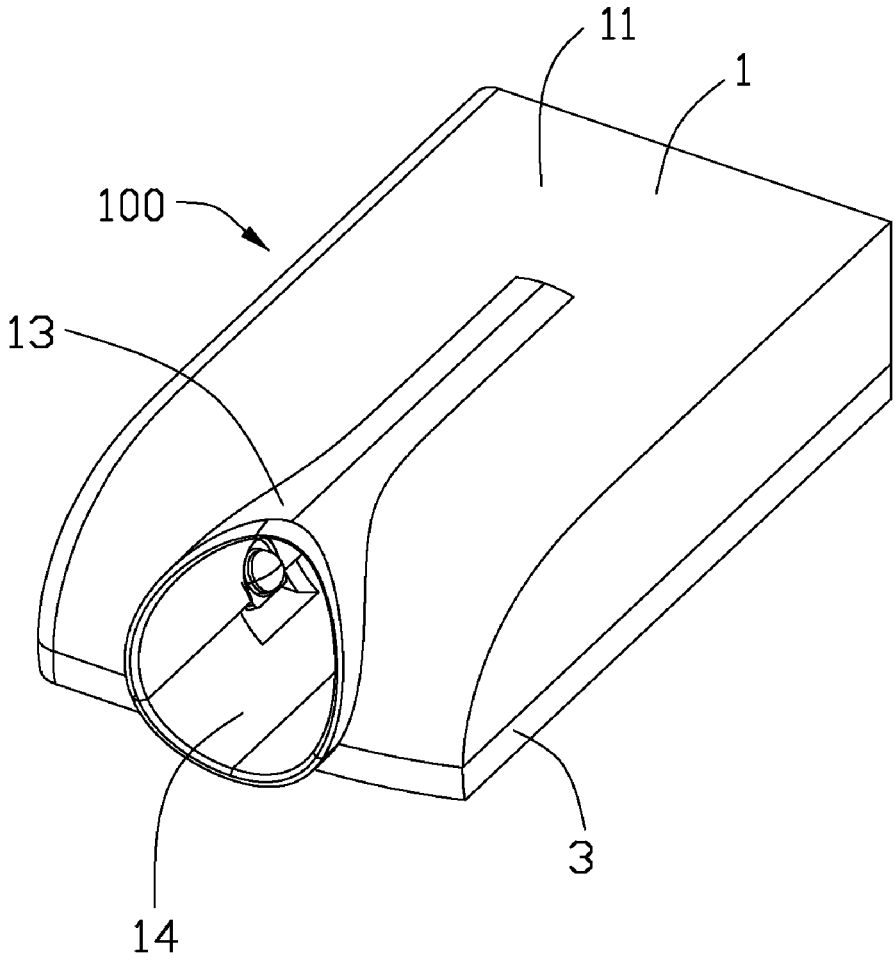
FIG. 1 is a perspective view of an audio jack connector according to the present invention.
Figure 2:
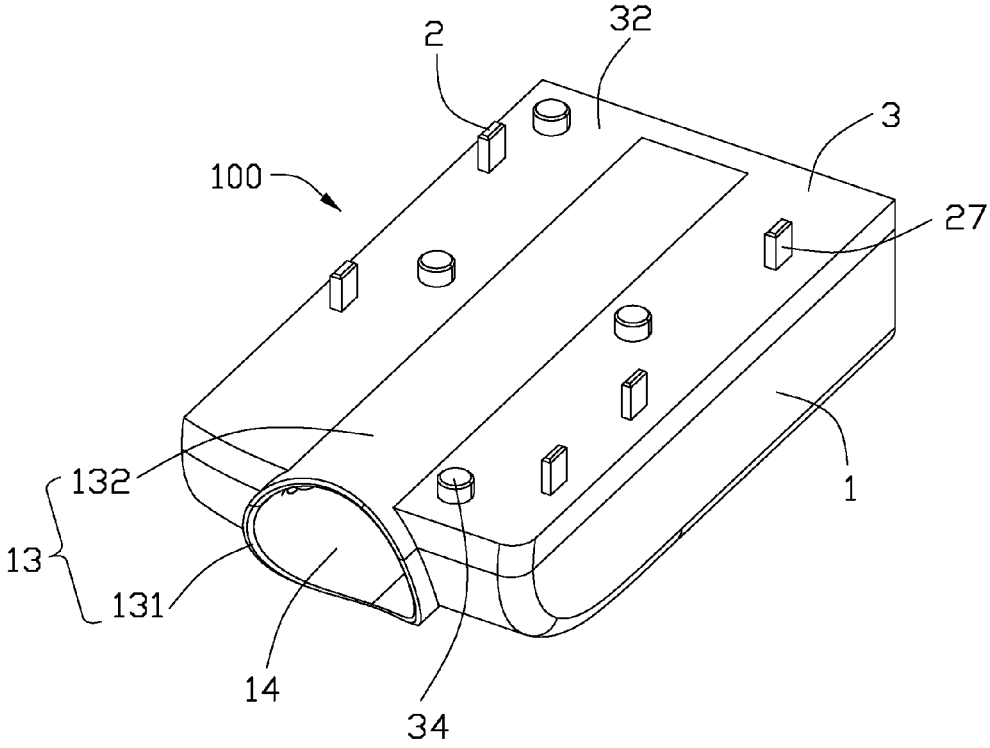
FIG. 2 is another perspective view of the audio jack connector shown in FIG. 1.
Figure 3:
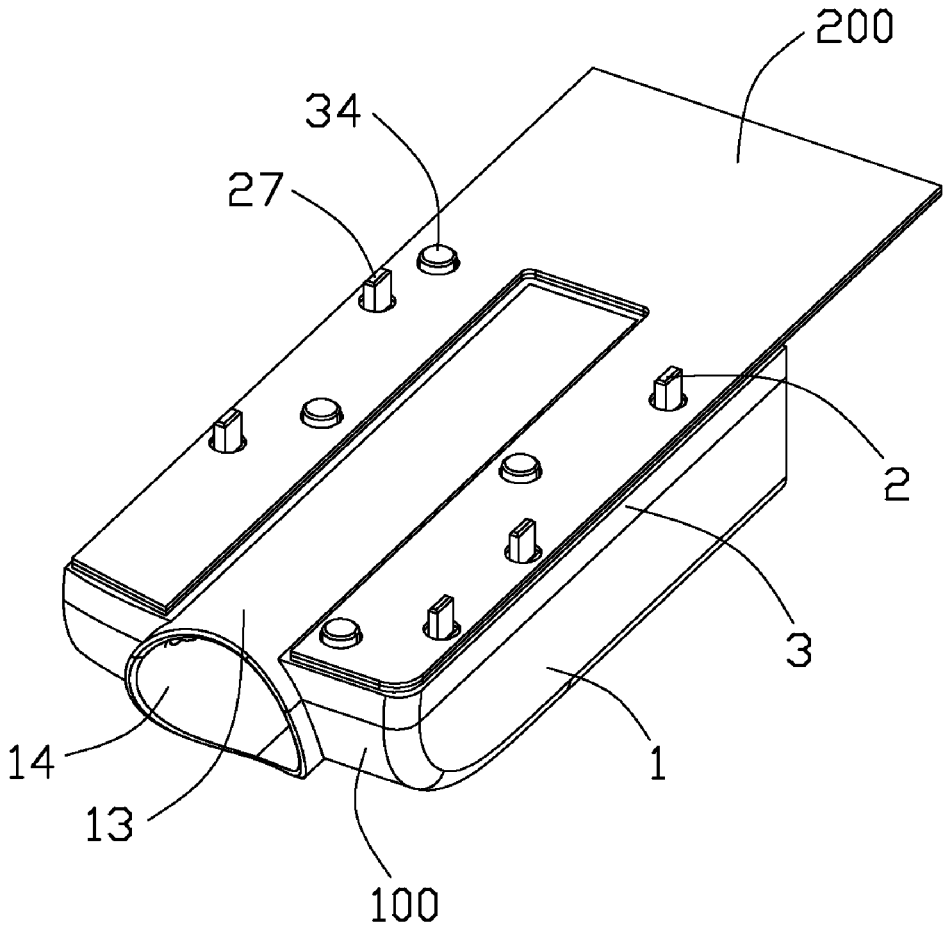
FIG. 3 is a perspective view of the audio jack connector shown in FIG. 1 mounted to a flexible circuit board.
Figure 4:
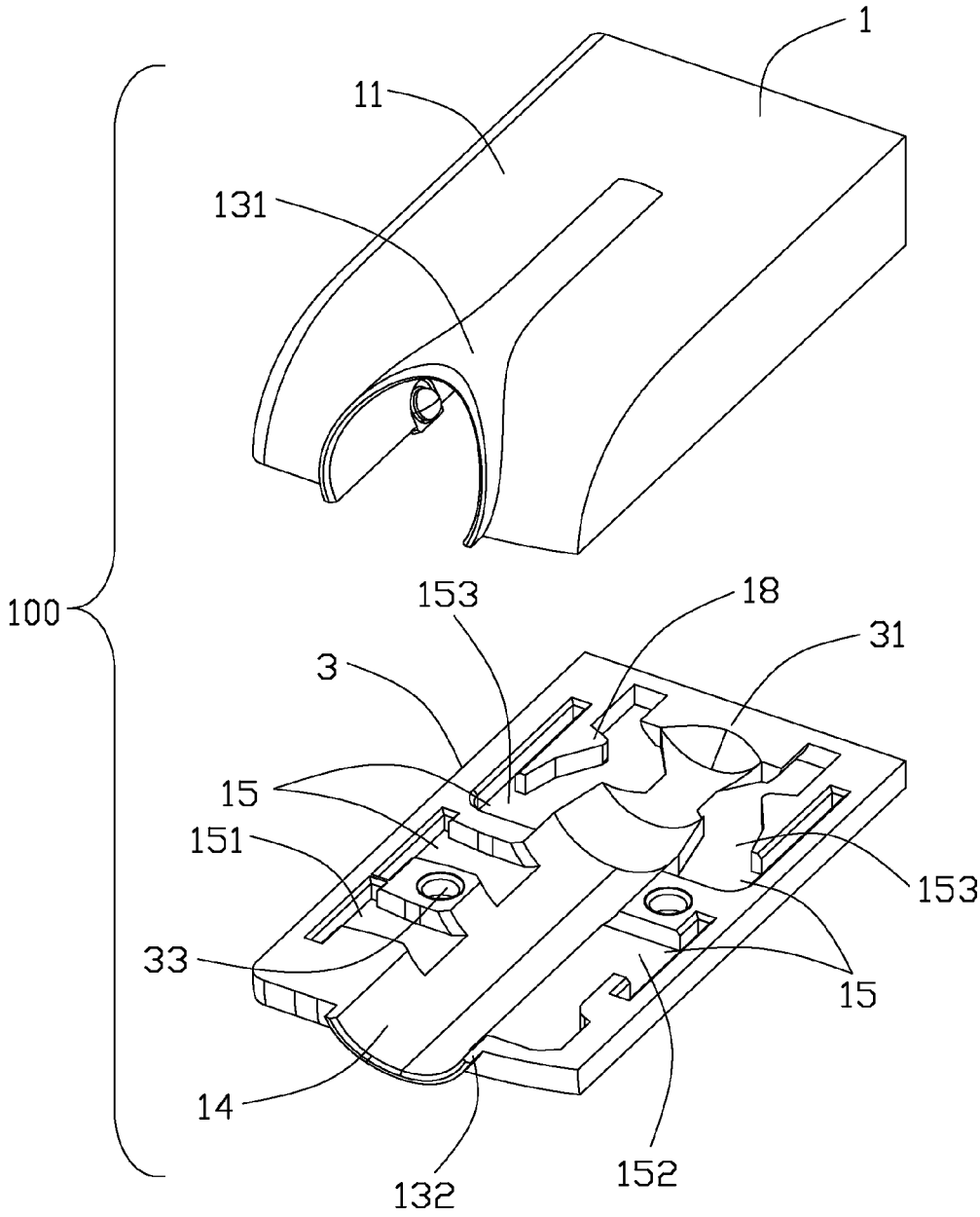
FIG. 4 is a partly exploded view of the audio jack connector shown in FIG. 1.
Figure 5:
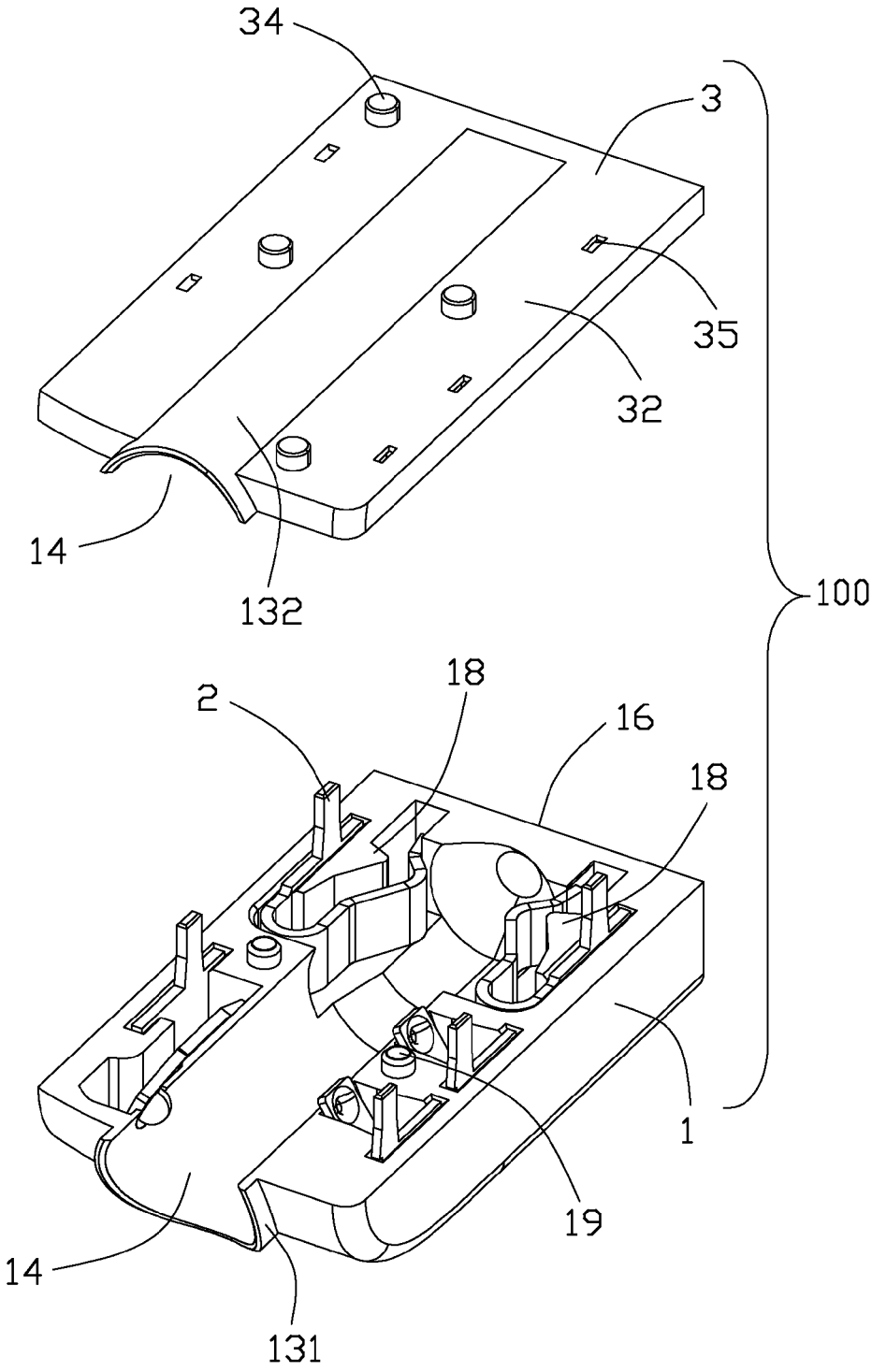
FIG. 5 is another partly exploded view of the audio jack connector shown in FIG. 1.

Referring to FIGS. 1-5, an audio jack connector 100 according to the present invention for insertion of an electrical plug (not shown) and being mounted to a flexible printed circuit (FPC) 200 is disclosed. In other embodiments, the audio jack connector 100 could be mounted to a printed circuit board (PCB) or other circuit board. The audio jack connector 100 includes an insulative housing 1, a plurality of contacts 2 retained in the insulative housing 1, and a cover 3 encapsulating the contacts 2 into the insulative housing 1.

Figure 6:
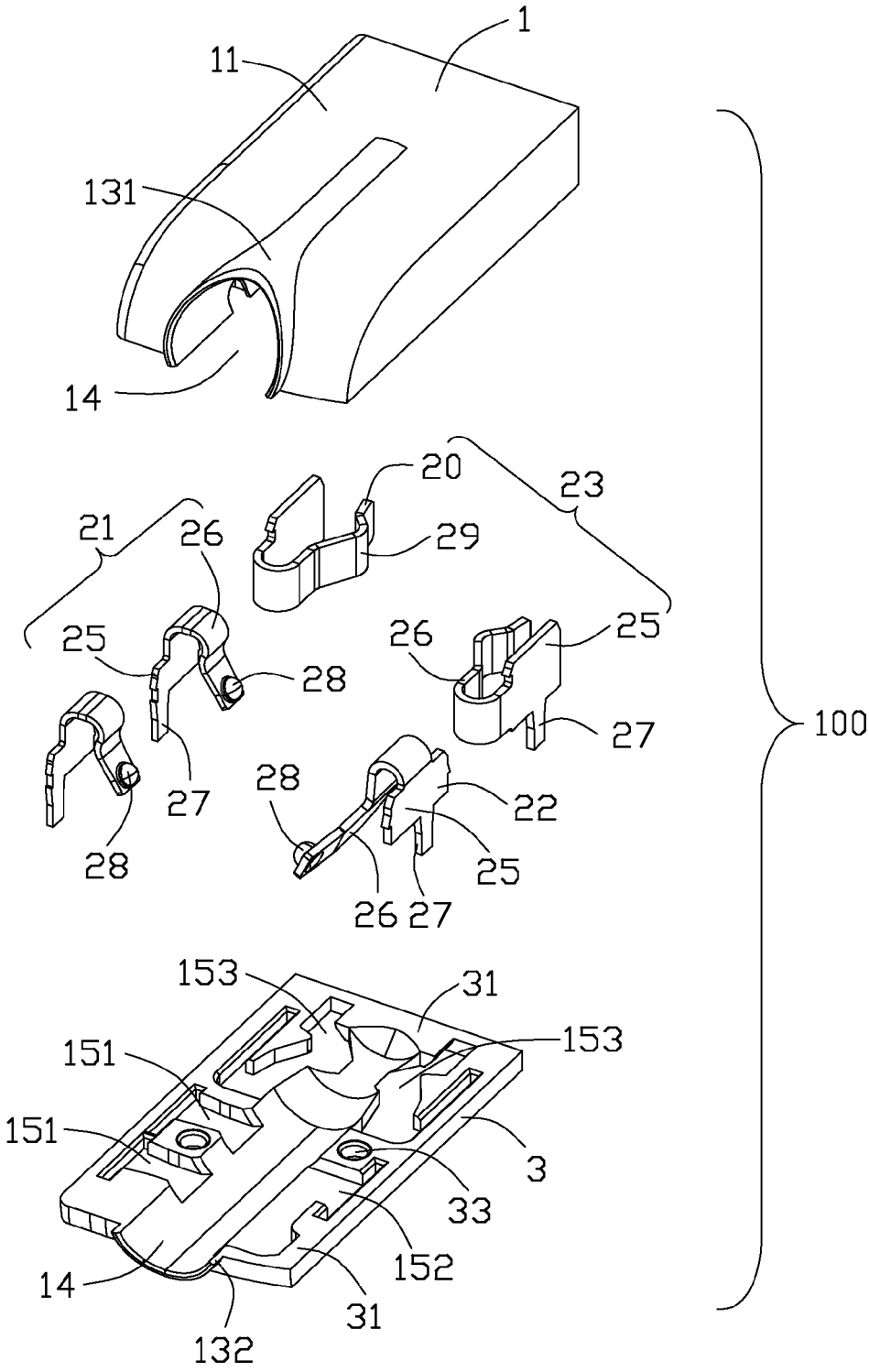
FIG. 6 is an exploded view of the audio jack connector shown in FIG. 1.
Figure 7:
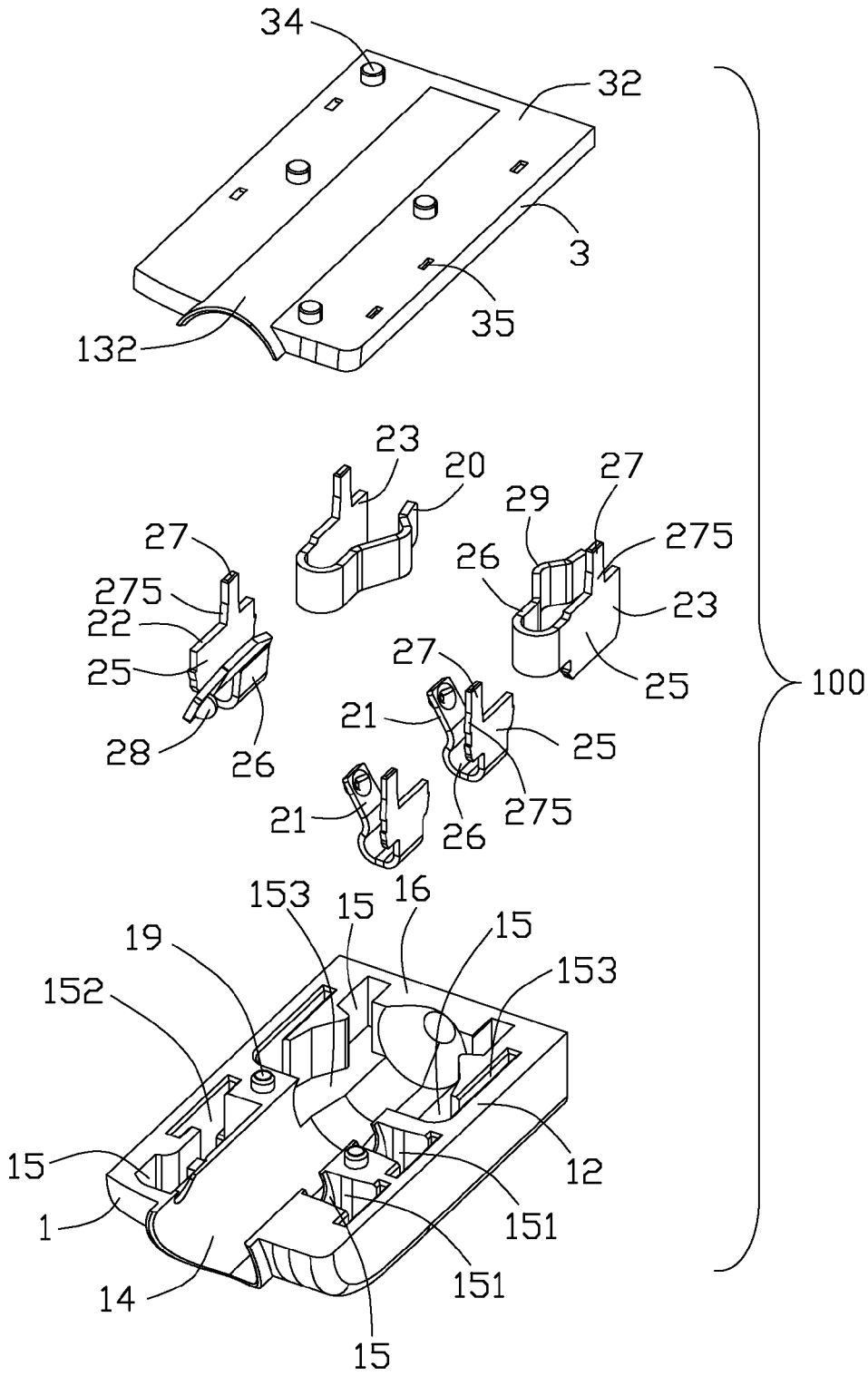
FIG. 7 is another exploded view of the audio jack connector shown in FIG. 1.

Referring to FIGS. 4-7, the insulative housing 1 and the cover 3 in this embodiment both are molded of dielectric material such as plastic or the like. In other embodiments, the cover 3 can be made of other waterproof materials such as chloroprene rubber, butyl rubber, PI Polyimide, PUR Polyurethane, etc. The insulative housing 1 and the cover 3 define a column 13 forming a columnar cavity 14 for insertion of the electrical plug, and a plurality of receiving slots 15 located at two sides of the cavity 14 and communicating with the cavity 14. The column 13 includes a first column 131 formed in the inuslative housing 1 and a second column 132 formed in the cover 3, the first column 131 protruding forwardly beyond a front side of the insulative housing 1 and upwardly beyond a top surface 11 of the insulative housing 1, the second column 132 protruding forwardly beyond a front side of the cover 3 and downwardly beyond a lower surface 32 of the cover 3. The cavity 14 includes a first part formed on the first column 131 and a second part formed on the second column 132. The cavity 14 has a front end exposed to exterior for the electrical plug inserted into the cavity 14, and a rear end opposite to the front end and enveloped by a rear wall 16 of the insulative housing 1. The receiving slots 15 include a pair of first receiving slots 151 being of a same configuration and located at left side of the cavity 14 in a front-to-rear direction, a second receiving slot 152 located at right side of the cavity 14, and a pair of third receiving slots 153 being of a symmetrical configuration and located symmetrically at two sides of the cavity 14. Each receiving slot 15 includes a first part defined by the insulative housing 1 and a second part defined by the cover 3. Each first part of the receiving slots 15 is recessed upwardly from a bottom surface 12 of the insulative housing 1. Each second part of the receiving slots 15 is recessed downwardly from an upper surface 31 of the cover 3. The insulative housing 1 and the cover 3 define a pair of protrusions 18 formed into the third receiving slots 153 and protruding toward the cavity 14. The insulative housing 1 has a pair of cylindrical embossments 19 extending downwardly from the bottom surface 12. The cover 3 has a pair of recesses 33 recessed downwardly from the upper surface 31 thereof for retaining the respective embossments 19 and a set of posts 34 extending downwardly from the lower surface 32 thereof for being mounted to the FPC 200. Therefore, the audio jack connector 100 could be retained on the FPC 200 firmly. In another embodiment, the column 13 and the receiving slots 15 can be defined only by the insulative housing 1, in this situation, the column 13 will protrude downwardly beyond the bottom surface 12 of the insulative housing 1 in addition, the receiving slots 15 are recessed upwardly from the bottom surface 12 of the insulative housing 1, the cover 3 is used for enveloping the receiving slots 15.

Referring to FIGS. 3 to 7, the contacts 2 include a pair of first contacts 21 being of a same configuration and received in the first receiving slots 151, a second contact 22 received in the second receiving slots 152, and a pair of third contacts 23 being of a symmetrical configuration and received in the third receiving slots 153. Each contact 2 has a base portion 25 retained in the respective receiving slot 15, a resilient portion 26 bending toward the cavity 14 from the base portion 25, and a tail portion 27 extending downwardly from the base portion 25 and outwardly from the cover 3 to be mounted in though holes of the FPC 200. Therefore, the cover 3 and the insulative housing 1 can encapsulate the contacts 2 only with the tail portions 27 extending outwardly from the cover 3 for being mounted in through holes of the FPC 200 to provide waterproof and dustproof effects. The cover 3 has a plurality of tapered holes 35 for the tail portions 27 passing through. The tapered holes 35 are tapered from the upper surface 31 to the lower surface 32. Each tail portion 27 has a tapered portion 275 tapered from an upper side to a lower side and fitting through the respective tapered holes 35 to prevent water and dust from entering into the receiving slot 15 more effectively. In another embodiment, the tail portions 27 can be insert molded into the cover 3 to prevent water and dust entering into the receiving slot 15 more effectively. The first and second contacts 21, 22 have convex contacting portions 28 protruding into the cavity 14 from the respective resilient portions 26 for contacting with the electrical plug. The third contacts 23 have arc contacting portions 29 protruding into the cavity 14 from the respective resilient portions 26 for contacting with the electrical plug, and retaining portions 20 extending from the respective arc contacting portions 29 and retained in the third receiving slots 153 for preventing the arc contacting portions 29 from inwardly over deformation. The protrusions 18 are located between the base portion 23 and the arc contacting portions 29 of the third contacts 23 for preventing the arc contacting portions 29 from outwardly over deformation.

In assembly, the contacts 2 are inserted into the first parts of the receiving slots 15 of the insulative housing 1 from the bottom surface 12, the cover 3 is assembled to the insulative housing 1 with the embossments 16 received in the recesses 33, the upper portion of the contacts 2 which is beyond the bottom surface 12 is received in the second parts of the receiving slots 15 of the cover 3, finally, the cover 3 and the insulative housing 1 are bonded together by ultrasonic welding or thermal adhesive. Therefore, the contacts 2 are encapsulated by the insulative housing 1 and cover 3 only with the tail portions 27 extending outwardly from the cover 3 for being mounted to the FPC, the cover 3 can make the audio jack connector 100 communicate with the exterior via only the front end of the cavity 14 to provide waterproof and dustproof effects.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An audio jack connector for insertion of an electrical plug comprising:

a plurality of contacts having contacting portions for contacting with the electrical plug and tail portions for being mounted to a circuit board;

an insulative housing and a cover encapsulating the contacts with the tail portions extending outwardly from the cover when assembled;

a cavity defined by the insulative housing and the cover for insertion of the electrical plug, the contacting portions protruding into the cavity; and a plurality of receiving slots defined by the insulative housing and the cover for receiving the contacts, the receiving slots being located at at least one side of the cavity and communicating with the cavity;

wherein the cavity comprises a first part defined in the insulative housing and a second part defined in the cover, each receiving slot comprises a first part defined in the insulative housing and a second part defined in the cover.

2. The audio jack connector according to claim 1, wherein the cover and the insulative housing are bonded together by ultrasonic welding.

3. The audio jack connector according to claim 2, wherein the tail portions are insert molded into the cover.

4. The audio jack connector according to claim 2, wherein the cover has a plurality of tapered holes passing therethrough and tapered from an upper surface to a lower surface, the tail portions have tapered portions tapered from a top side to a lower side and fitting through the respective tapered holes.

5. The audio jack connector according to claim 2, wherein the cover has a plurality of recesses recessed from an upper surface thereof and a plurality of posts extending downwardly from a lower surface thereof for being mounted to the circuit board, the insulative housing has a plurality of embossments extending downwardly from the bottom surface for being received in the respective recesses.

6. The audio jack connector according to claim 1, wherein the cavity has a front end exposed to exterior for the electrical plug inserted into the cavity, and a rear end opposed to the front end and enveloped by a rear wall of the insulative housing.

7. An audio jack comprising:

an insulative upper housing and an insulative lower cover assembled together to commonly defining therebetween a columnar plug receiving cavity which forwardly communicates with an exterior in a front-to-back direction, said housing defining opposite bottom and upper faces, and said cover defining opposite bottom and upper surfaces under condition that the upper surface of the cover abuts against the bottom face of the housing;

said housing defining a plurality of contact receiving slots beside the plug receiving cavity and extending from the bottom face of the housing toward the upper face and terminated before reaching the upper face;

a plurality of contacts respectively inserted into the corresponding contact receiving slots with contacting sections extending into the plug receiving cavity;

the cover defining a plurality of through holes extending through both said upper surface and said bottom surface to snugly receive tails of the corresponding contacts, respectively; wherein the cover defines a constant thickness except a middle portion in a transverse direction perpendicular to said front-to-back direction under condition that said middle portion defines a downward curvedly recess to form a lower part of said columnar plug receiving cavity.

8. The audio jack as claimed in claim 7, wherein a plurality of posts extend downwardly from a bottom surface of the cover.

9. The audio jack as claimed in claim 8, wherein a front upper periphery edge of the plug receiving cavity formed on the housing extends rearwardly while a front lower periphery edge of the plug receiving cavity formed on the cover extends essentially in a vertical direction perpendicular to both said front-to-back direction and said transverse direction.

10. The audio jack as claimed in claim 9, wherein said cover defines a front flange on which the front lower periphery edge is formed, and said housing defines another front flange on which the front upper periphery edge is formed.

11. The audio jack as claimed in claim 7, wherein said cover defines a plurality of contact receiving grooves corresponding to said contact receiving slots to commonly receive the corresponding contacts therein.

12. The audio jack as claimed in claim 11, wherein said housing and said cover are made with same material with same rigidity thereof.

* * * * *